United States Patent [19]

Reynolds et al.

[11] Patent Number: 4,941,395

[45] Date of Patent: Jul. 17, 1990

[54] BENT-AXIS HYDRAULIC APPARATUS

[75] Inventors: Richard W. Reynolds; Mark S. Stroze, both of Rockford, Ill.

[73] Assignee: Sundstrand Corporation, Rockford, Ill.

[21] Appl. No.: 241,701

[22] Filed: Sep. 8, 1988

[51] Int. Cl.[5] ..... F01B 13/04

[52] U.S. Cl. ..... 92/57; 92/71; 91/507

[58] Field of Search ..... 92/12.2, 54, 57, 70, 92/71; 74/800; 464/154; 475/163, 164; 91/499, 502, 507

[56] References Cited

U.S. PATENT DOCUMENTS

| | | | |
|---|---|---|---|
| 5,185 | 7/1847 | Benson | 91/507 |
| 1,285,197 | 11/1918 | Irgens | 92/57 |
| 2,035,171 | 3/1936 | Loewus | 64/9 |
| 2,177,008 | 10/1939 | Snader et al. | 121/62 |
| 2,380,113 | 7/1945 | Kuhns | 64/9 |
| 2,403,854 | 12/1944 | Geyer et al. | 91/507 |
| 2,841,966 | 7/1958 | Belden et al. | 64/9 |
| 2,949,041 | 8/1960 | Wildhaber | 74/416 |
| 2,990,784 | 7/1961 | Wahlmark | 103/162 |
| 3,013,411 | 12/1961 | Wahlmark | 64/21 |
| 3,117,430 | 1/1964 | Mueller | 64/9 |
| 3,174,302 | 3/1965 | Pomper | 64/9 |
| 4,012,994 | 3/1977 | Malmros | 91/499 |
| 4,664,018 | 5/1987 | Eickmann | 92/57 |

*Primary Examiner*—Edward K. Look

*Attorney, Agent, or Firm*—Wood,Phillips,Mason, Rectenwald & VanSanten

[57] ABSTRACT

A bent-axis hydraulic apparatus having a case in which a rotatable cylinder block is positioned and which is associated with a rotatable shaft at a drive angle therebetween. A split angle spline drive interconnects the cylinder block of the hydraulic axial piston unit with a rotatable shaft for transmission of torque therebetween without any side loading on the pistons of the axial piston unit. The split angle spline drive has two series of external teeth associated one with the cylinder block and the other with the rotatable shaft which individually mesh at two locations opposite the axis of rotation thereof with two spaced-apart sets of internal teeth on a ring gear that is rotatably-mounted in fixed location within the case of the hydraulic apparatus. The tooth mesh center lines are equally spaced from the pivot point for the cylinder block and the rotatable shaft to achieve synchronization.

8 Claims, 1 Drawing Sheet

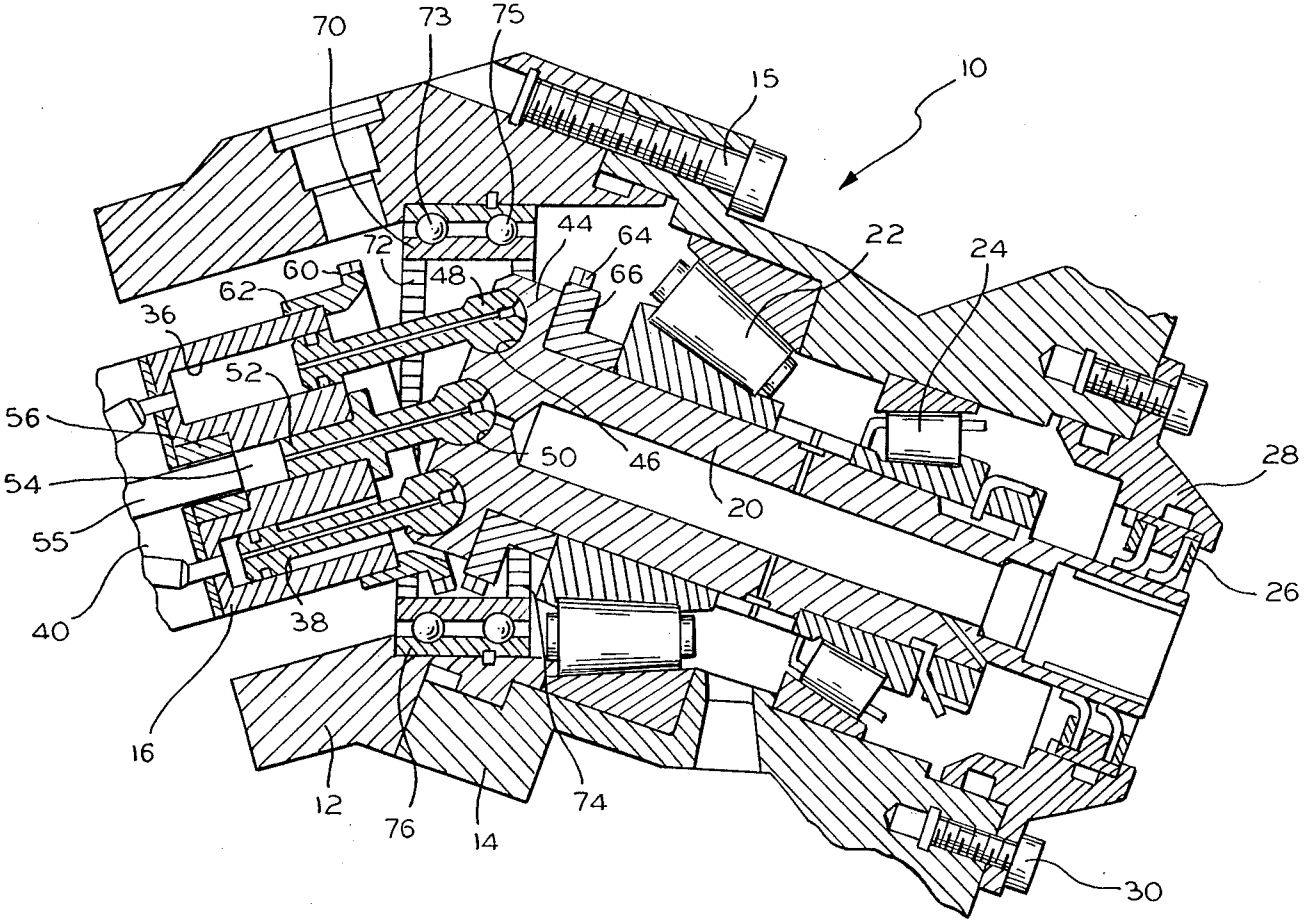
10
15
20
22
24
26
28
30
12
14
16
36
38
40
44
46
48
50
52
54
55
56
60
62
64
66
70
72
73
74
75
76

BENT-AXIS HYDRAULIC APPARATUS

DESCRIPTION

1. Field of the Invention

This invention relates to a bent-axis hydraulic apparatus and, more particularly, to a split angle spline drive for transmitting torque between a hydraulic unit having a rotatable cylinder block with a plurality of reciprocal pistons and a rotatable shaft related to the cylinder block at a drive angle. The split angle spline drive provides for synchronous operation of the cylinder block and the shaft.

2. Background of the Invention

The operation of any fixed axis hydraulic axial piston pump or motor requires the synchronous operation of the cylinder block and an associated rotatable shaft. A bent-axis hydraulic apparatus wherein the axial piston unit is a motor has use in high performance aircraft wherein a synchronizing device operable between the cylinder block and an output shaft must perform at high accelerations during motor reversal for millions of cycles. Previously known synchronizing devices have not satisfactorily perfected to the required standard or have not had a high level of accuracy and satisfactory cost to satisfy the necessary performance levels.

One type of sYnchronizing device known in the art is a universal yoke-type joint which transmits its motion from the cylinder block of the motor through four pin joints arranged in a cross pattern. The diametral size of the joint is magnitude smaller when compared to the diameter of the cylinder block and, because of this compact packaging, pin-to-yoke clearance emerges as a weak link in the universal yoke-type point. As tolerance and wear stack up and slacken the pin-to-yoke fit, shock loading becomes more severe and seemingly minor aberrations in clearance quickly cause the joint to fail.

Another type of synchronizing device known in the art embodies the use of a bevel gear set with a bevel gear on each of the cylinder block and the output shaft. The bevel gear set has a single-point mesh and requires precise shaft locations to prevent interference and control backlash. In order to adequately control backlash, matched machined bevel gear sets are required and this pairing of components makes production and replacement costly. The single-point mesh results in an unbalanced force on the cylinder block which requires additional support measures for the cylinder block.

SUMMARY OF THE INVENTION

A primary feature of the invention is to provide a bent-axis hydraulic apparatus having a split angle spline drive for achieving synchronous operation of a cylinder block of an axial piston pump or motor and an associated rotatable shaft.

An embodiment of the invention for achieving synchronous operation has a first series of external teeth carried by a cylinder block of the axial piston unit and a second series of external teeth carried by the rotatable shaft. The axes of rotation of the cylinder block and rotatable shaft intersect at a block/shaft pivot point. An internally-toothed ring gear rotatably supported by the case of the hydraulic apparatus envelops said two series of external teeth in circumjacent relation and has two sets of internal teeth disposed in spaced-apart planes. With the drive angle between the cylinder block and the shaft, there are diametrically-opposite tooth meshes between one set of internal teeth of the ring gear and the first series of external teeth and between the other set of internal teeth of the ring gear and the second series of external teeth and which are equally spaced from said block/shaft pivot point. The enveloping of the cylinder block and shaft by the internal ring gear reduces the criticality of shock loading as encountered with the yoke-type universal joint by eliminating the point contact areas placed at a small radius to the applied load and replacing the contact areas with multi-tooth contacts at a radius greater than the applied load.

Additionally, the split angle spline drive, because of the greater load sharing by the multi-tooth contacts, relaxes the tooth form and gear alignment practices as required in the manufacture of a bevel gear set synchronizing device. The split angle spline drive is considerably less expensive to produce and assemble b ®cause of the relaxed tolerances as compared to the bevel gear set synchronizing device. In addition, the pair of meshes provided by the diametrically-opposite meshes between the sets and series of teeth avoids the requirement for additional support measures for the cylinder block.

An object of the invention is to provide a split angle spline drive for making a drive connection between a cylinder block of an axial piston unit and an associated rotatable shaft which is an output shaft when the axial piston unit is operating as a motor.

Still another object of the invention is to provide a split angle spline drive as set forth in the preceding paragraph wherein each of the cylinder block and shaft have a series of external teeth disposed in nonparallel planes because of a drive angle therebetween, and a ring gear with two spaced-apart sets of internal teeth surrounds the cylinder block and shaft and is rotatably-supported in fixed relation to a case of the hydraulic apparatus. The spacing between the sets of internal teeth on the ring gear provides two diametrically-opposite tooth meshes between the first series of teeth on the cylinder block and one set of internal teeth on the ring gear and between the second series of external teeth on the shaft and the other set of internal teeth on the ring gear. The diametrically-opposite gear meshes synchronize rotation of and transmit torque between the cylinder block and the shaft with the split angle spline drive functioning as a constant velocity joint for maintaining constant torque loading.

Still another object of the invention is to provide a spline drive for a hydraulic unit having a case, a rotatable cylinder block with a plurality of reciprocal pistons and a rotatable shaft, the axes of rotation of said cylinder block and rotatable shaft being at a drive angle relative to each other and an end of said pistons coacting with the drive shaft, comprising: two annular series of external teeth with a series on each of the cylinder block and the rotatable shaft; a ring gear having two spaced-apart sets of internal teeth; and means rotatably mounting the ring gear within the case and at a location to divide the drive angle equally and have two diametrically-opposite tooth meshes between a set of ring gear internal teeth and the series of external teeth on the cylinder block and between the other set of ring gear internal teeth and the series of external teeth on the rotatable shaft.

A further object of the invention is to provide a bent-axis hydraulic apparatus comprising, a case, a hydraulic axial piston motor in the case having a rotatable cylinder block and a plurality of reciprocal pistons, a rotatable output shaft in the case having its axis of rotation at an angle to the axis of rotation of the cylinder block to provide a drive angle therebetween, a plurality of reciprocal pistons carried by said cylinder block and engageable with said output shaft, a pair of externally-toothed annular splines mounted one on said cylinder block and one on said output chart, a ring gear circumjacent said splines and having two sets of internal teeth disposed in spaced-apart planes, and means mounting said ring gear on said case for rotation with opposite tooth meshes between the sets of internal teeth and the teeth of said splines for transmission of torque from the motor to the output shaft, and the tooth meshes with the two sets of ring gear teeth are equally spaced from a block/shaft pivot point defined at the intersection of the axes of rotation of the cylinder block and output shaft.

DESCRIPTION OF THE DRAWING

The Figure is a fragmentary central vertical section of the bent-axis hydraulic apparatus.

DESCRIPTION OF THE PREFERRED EMBODIMENT

The hydraulic apparatus has a case, indicated generally at 10, made up of sections 12 and 14 secured together by threaded members 15. The case section 12 has a bore in which a cylinder block 16 of an axial piston unit is rotatable.

The case section 14 has a bore in which a rotatable shaft 20 is rotatably mounted by taper roller bearings 22 and 24. An oil seal 26 seals an outboard end of the shaft 20 and is supported by an end cap 28 attached to the case section 14 by threaded members 30.

When the axial piston unit is operating as a motor, the rotatable shaft 20 is an output shaft and when the axial piston unit is operating as a pump, the rotatable shaft 20 is a drive shaft.

The cylinder block 16 has a circular array of cylinders 36 with a conventional-type piston 38 reciprocal in each of the cylinders. Control of fluid flow to and from the left-hand end of the cylinders 36, as viewed in the Figure, is under the control of a valve plate 40 in a manner well known in the art.

A disc 44 is positioned at an inboard end of the rotatable shaft 20 and, as shown, is formed integrally therewith. The disc 44 has a circular array of generally hemispherical sockets 46 to provide swivel mountings for enlarged ends 48 of the pistons 38. The axes of rotation of the cylinder block 16 and the rotatable shaft 20 are at an angle to define a drive angle whereby the pistons 38 may reciprocate in the cylinders 36. In one revolution of the cylinder block and rotatable shaft, each of the pistons 38 will reciprocate through one complete stroke of movement.

An additional generally hemispherical socket 50, formed in the disc 44 and centered on the axis of rotation of the rotatable shaft 20 swivelly mounts an end of a center shaft 52 and which has an end thereof fitted in a bore 54 of the cylinder block coaxial with the axis of rotation of the cylinder block. This center shaft as well as a shaft 55 positioned in a bearing 56 and the gear meshes to be described rotatably support the cylinder block.

A split angle spline drive provides for synchronization of rotation of the cylinder block 16 and the rotatable shaft 20. This spline drive comprises a first series of external teeth 60 associated with the cylinder block 16 and shown as being integral with an annular spline member 62 fitted in surrounding fixed relation with the cylinder block 16. A second series of external teeth 64 are associated with the rotatable shaft 20 and are shown as integral with an annular spline member 66 fixed on the rotatable shaft. Each series of external teeth 60 and 64 are disposed in a plane and with the planes of the two series of teeth being at the drive angle defined by the angle between the cylinder block 16 and the rotatable shaft 20.

The cylinder block 16 and rotatable shaft 20 have their axes of rotation intersecting at a block/shaft pivot point. This is a point about which these elements theoretically are pivoted to achieve the total drive angle therebetween.

The spline drive further includes an internal ring gear 70 having two sets of spaced-apart internal teeth. One set of internal teeth 72 coacts with the first series of external teeth 60 associated with the cylinder block. The second set of internal teeth 74 coacts with the external teeth 64 associated with the rotatable shaft. There are a pair of non-diametrically opposed tooth meshes between the coacting set and series of teeth, with one of the meshes occurring at the opposite side of the cylinder block and the rotatable shaft, as shown, and the other tooth meshes occurring at the opposite sides of the cylinder block and rotatable shaft above the plane of the Figure.

Internal ring gear 70 is rotatably fixed in the case by plural rows 73 and 75 of ball bearings which coact between the outer peripheral surface of the ring member functioning as an inner race and an annular outer race member 76 fixed to the case section 12. The internal ring member 70 has an axis of rotation extending normal to the plane of the sets of teeth 72 and 74 and which has the axes of rotation of the cylinder block 16 and the rotatable shaft 20 at equal angles relative thereto. The cylinder block and rotatable shaft are also at equal angles to a line which is parallel to the axis of rotation of ring gear 70 and--. extended through the block/shaft pivot point, previously described The sum of these equal angles provides the total drive angle. Because of the equal angles, the split angle spline drive provides a true constant velocity joint The spacing between the sets of internal teeth 72 and 74 and orientation of the ring gear 70 results in intersections of the planes of the series of teeth 60 and 64 with the sets of internal teeth 72 and 74 to provide tooth mesh center lines which intersect with the axes of the cylinder block 16 and rotatable shaft 20 equidistant from the pivot point. As a result, the drive transmitted between the cylinder block and the rotatable shaft will be a pure couple and, with the total drive angle being divided equally, there is a true, constant velocity joint Because of the sliding contact between the teeth, which are in mesh, resulting from the angularly related planes of the sets and series of teeth, the external teeth 60 associated with the cylinder block and the external teeth 64 associated with the rotatable shaft have a slightly crowned diamond shape with the angle of the diamond being selected in conformity with the drive angle. The Wahlmark Patent No. 3,013,411 relating to a gear-type constant velocity joint discloses the design of diamond-shape teeth for angled drives and the disclosure is incorporated herein by reference.

In operation, with the axial piston unit functioning as a motor, fluid under pressure is delivered to the cylinders 36 of the cylinder block 16 through the valve plate 40 in a known manner. As the pistons are forced outwardly, the force is reacted at the disc 44 associated with the output shaft to cause rotation of the output shaft 20, with the motion being transmitted through the split angle spline drive to the cylinder block 16. The split angle spline drive provides a constant torque load for improved wear of the components and avoids the transmission of torque from the rotatable shaft to the cylinder block directly through the pistons and, thus, avoids side loads on the pistons. If the axial piston unit is to be used as a pump, transmission of torque is reversed with the rotatable shaft 2 being an input shaft causing rotation of the cylinder block 16 through the split angle spline drive. The pistons 38 are caused to reciprocate because of the coaction with the angularly-related disc 44 whereby fluid received in certain cylinders at low pressure can be discharged from the cylinders 36 at a higher pressure.

I claim:

1. A spline drive for a hydraulic unit having a case, a rotatable cylinder block with a plurality of reciprocal pistons and a rotatable shaft having a total drive angle therebetween, the axes of rotation of said cylinder block and rotatable shaft being at equal angles which together provide the total drive angle and an end of said pistons being movably connected to the drive shaft whereby there is rotation of the cylinder block and rotatable shaft with simultaneous reciprocation of the pistons, said spline drive comprising: two annular series of external teeth with a series on each of the cylinder block and the rotatable shaft; a ring gear having two spaced-apart sets of internal teeth; and means rotatably mounting the ring gear within the case and at a location bisecting the total drive angle to have two non-diametrically opposed tooth meshes between a set of ring gear internal teeth and the series of teeth on the cylinder block and between the other set of ring gear internal teeth and the series of teeth on the rotatable shaft.

2. A bent-axis hydraulic apparatus comprising, a case, a hydraulic axial piston unit in the case having a rotatable cylinder block and a plurality of reciprocal pistons, a rotatable shaft in the case having its axis of rotation at an angle to the axis of rotation of the cylinder block to provide a drive angle therebetween, a disc at an end of said shaft having a plurality of circularly-arranged generally hemispherical sockets, said pistons having a shaped end to swivel one in each of said sockets during rotation of said cylinder block and disc, a pair of externally-toothed annular splines mounted one on said cylinder block and one on said rotatable shaft, a ring gear circumjacent said splines and having two sets of internal teeth disposed in spaced-apart planes, and bearing means mounting said ring gear on said case for rotation with non-diametrically opposed-tooth meshes between the sets of internal teeth can the teeth of said splines.

3. A bent-axis hydraulic apparatus comprising, a case, a hydraulic axial piston unit in the case having a rotatable cylinder block and a plurality of reciprocal pistons, a rotatable shaft in the case having its axis of rotation at an angle to the axis of rotation of the cylinder block to provide a drive angle therebetween, a disc at an end of said shaft, said pistons each having an end movably-mounted to said disc, a first series of external teeth carried by said cylinder block and a second series of external teeth carried by said rotatable shaft, a ring gear circumjacent said series of external teeth and having two sets of internal teeth disposed in spaced-apart planes, and bearing means mounting said ring gear on said case for rotation with opposite tooth meshes between one set of internal teeth and the first series of external teeth and between the other set of internal teeth and the second series of external teeth, said ring gear being oriented and the spacing between the sets of internal teeth being selected whereby the tooth mesh center lines as defined by planes of intersection of ring gear internal teeth with the cylinder block and shaft teeth are equally spaced from a pivot point where the axes for the cylinder block and the rotatable shaft intersect.

4. A bent-axle hydraulic apparatus comprising, a case, a hydraulic axial piston motor in the case having a rotatable cylinder block and a plurality of reciprocal pistons, a rotatable output shaft in the case having its axis of rotation at an angle to the axis of rotation of the cylinder block to provide a drive angle therebetween, a plurality of reciprocal pistons carried by said cylinder block and engaged with said output shaft, a pair of externally-toothed annular splines mounted one on said cylinder block and one on said output shaft, a ring gear circumjacent said splines and having two sets of internal teeth disposed in spaced-apart planes, and means mounting said ring gear on said case for rotation with non-diametrically opposed tooth meshes between the sets of internal teeth and the teeth of said splines for timing of said cylinder block to said output shaft.

5. A spline drive as set forth in claim 1 wherein said hydraulic unit is an axial piston motor and said rotatable shaft is an output shaft driven by the motor.

6. A spline drive as set forth in claim 1 wherein each of the hydraulic unit and rotatable shaft are at fixed equal drive angles relative to a line extending through the pivot points of the cylinder block and rotatable shaft with the sum of the equal drive angles providing the total drive angle.

7. A bent-axis hydraulic apparatus as in claim 2 wherein said hydraulic axial piston unit is a motor and said rotatable shaft is an output shaft driven by the motor.

8. A spline drive as defined in claim 6 wherein tooth mesh center lines as defined by planes of intersection of ring gear internal teeth with the cylinder block teeth and shaft teeth intersect with the axes of the cylinder block and the rotatable shaft equidistant from said pivot point.

* * * * *